US008672045B2

(12) United States Patent
Whitney

(10) Patent No.: US 8,672,045 B2
(45) Date of Patent: Mar. 18, 2014

(54) FIRE SUPPRESSION SYSTEMS AND METHODS

(75) Inventor: Paul K Whitney, Lynchburg, VA (US)

(73) Assignee: Whitney Projects LLC, Lynchburg, VA (US)

( * ) Notice: Subject to any disclaimer, the term of this patent is extended or adjusted under 35 U.S.C. 154(b) by 741 days.

(21) Appl. No.: 11/757,078

(22) Filed: Jun. 1, 2007

(65) Prior Publication Data

US 2008/0017393 A1 Jan. 24, 2008

Related U.S. Application Data

(60) Provisional application No. 60/809,963, filed on Jun. 1, 2006.

(51) Int. Cl.
*A62C 37/10* (2006.01)

(52) U.S. Cl.
USPC ..... 169/60; 169/56; 169/61; 169/65; 169/69; 239/282; 239/537; 239/583

(58) Field of Classification Search
USPC ..... 169/60, 46, 26, 88, 77, 21, 29, 19, 47, 169/56, 61, 65, 89; 239/280, 282, 283, 237, 239/240, 241, 69, 537, 541, 583
See application file for complete search history.

(56) References Cited

U.S. PATENT DOCUMENTS 4,175,677 A * 11/1979 Poeschl et al. ..... 222/5
4,265,316 A * 5/1981 Fee ..... 169/19
4,308,911 A 1/1982 Mandl
4,363,031 A 12/1982 Reinowitz
4,558,181 A 12/1985 Blanchard et al.
4,650,004 A * 3/1987 Wendling et al. ..... 169/85
4,763,115 A 8/1988 Cota
4,830,116 A * 5/1989 Walden et al. ..... 169/65
4,834,188 A 5/1989 Silverman
4,944,216 A 7/1990 McCutchen
4,951,755 A * 8/1990 Barnett et al. ..... 169/26
4,977,818 A 12/1990 Taylor et al.
5,123,490 A * 6/1992 Jenne ..... 169/61
5,198,809 A 3/1993 Day
5,475,364 A 12/1995 Kenet
5,505,266 A * 4/1996 Fujiki ..... 169/60

(Continued)

OTHER PUBLICATIONS

Patent Cooperation Treaty, International Search Report, International Application No. PCT/US2007/012954, mailed Nov. 21, 2008.

(Continued)

*Primary Examiner* — Justin Jonaitis
(74) *Attorney, Agent, or Firm* — Kilpatrick Townsend Stockton LLP

(57) ABSTRACT

Fire suppression systems and methods are described. One described system includes a housing configured to house a container of a fire suppression material, a delivery block in fluid communication with the container, and a nozzle in fluid communication with the delivery block and configured to disperse the fire suppression material from the delivery block. The described system can also include a power supply; a thermal indicator coupled to the power supply and operable to: detect the presence of a fire, generate a first signal indicating the presence of the fire, and transmit the first signal; and an actuator coupled to the power supply, the actuator in communication with the thermal indicator and configured to cause the fire suppression material to be transferred from the container to the delivery block in response to receipt of the first signal.

33 Claims, 7 Drawing Sheets

(56) References Cited

U.S. PATENT DOCUMENTS

| | | | | |
|---|---|---|---|---|
| 5,513,708 | A * | 5/1996 | Sundholm | 169/37 |
| 5,568,535 | A | 10/1996 | Sheffer et al. | |
| 5,576,739 | A | 11/1996 | Murphy | |
| 5,793,296 | A | 8/1998 | Lewkowicz | |
| 5,801,940 | A | 9/1998 | Russ et al. | |
| 5,808,541 | A * | 9/1998 | Golden | 340/286.05 |
| 5,816,331 | A * | 10/1998 | Vivier | 169/30 |
| 5,838,243 | A | 11/1998 | Gallo | |
| 5,848,649 | A * | 12/1998 | Matsumoto et al. | 169/26 |
| 5,850,180 | A | 12/1998 | Hess | |
| 5,871,057 | A * | 2/1999 | Stehling et al. | 169/65 |
| 5,908,159 | A | 6/1999 | Rudolph | |
| 5,945,924 | A | 8/1999 | Marman | |
| 5,950,150 | A | 9/1999 | Lloyd et al. | |
| 5,979,565 | A | 11/1999 | Wicks et al. | |
| 6,061,430 | A | 5/2000 | Miller et al. | |
| 6,118,381 | A | 9/2000 | James | |
| 6,157,943 | A | 12/2000 | Meyer | |
| 6,215,404 | B1 | 4/2001 | Morales | |
| 6,216,793 | B1 * | 4/2001 | Sundholm | 169/54 |
| 6,244,353 | B1 * | 6/2001 | Greer | 169/61 |
| 6,281,790 | B1 | 8/2001 | Kimmel et al. | |
| 6,384,723 | B1 | 5/2002 | Keeler et al. | |
| 6,474,086 | B1 | 11/2002 | Liu | |
| 6,742,599 | B1 * | 6/2004 | Nam | 169/30 |
| 6,873,256 | B2 | 3/2005 | Lemelson et al. | |
| 6,989,757 | B2 | 1/2006 | Geoffrey et al. | |
| 7,169,039 | B2 | 1/2007 | Oppedisano et al. | |
| 2001/0025349 | A1 | 9/2001 | Sharood et al. | |
| 2001/0048030 | A1 | 12/2001 | Sharood et al. | |
| 2002/0012323 | A1 | 1/2002 | Petite et al. | |
| 2002/0183001 | A1 | 12/2002 | Holter et al. | |
| 2003/0010509 | A1 | 1/2003 | Hoffman | |
| 2003/0150625 | A1 * | 8/2003 | Smith et al. | 169/56 |
| 2004/0129434 | A1 * | 7/2004 | Tan | 169/37 |
| 2004/0188104 | A1 | 9/2004 | Borisov et al. | |
| 2005/0046563 | A1 | 3/2005 | Whitney | |
| 2005/0167122 | A1 * | 8/2005 | Trapp | 169/52 |
| 2006/0289175 | A1 * | 12/2006 | Gutowski et al. | 169/46 |

OTHER PUBLICATIONS

1500 Series, Fire Alarm Control Panels, ESL Product Information Bulletin, 2001.

International Preliminary Report on Patentability mailed Dec. 31, 2008, corresponding to PCT/US2007/012954.

* cited by examiner

FIRE SUPPRESSION SYSTEMS AND METHODS

CROSS-REFERENCES TO RELATED APPLICATIONS

This application claims priority to U.S. Provisional Patent Application No. 60/809,963, filed Jun. 1, 2006, entitled "Range Safety Systems and Methods," the entirety of which is incorporated by reference.

FIELD OF THE INVENTION

The present invention relates generally to fire suppression systems and methods.

BACKGROUND OF THE INVENTION

The number of residential fires continues to increase. Twenty-five to thirty percent of these fires begin in the kitchen. The largest single category and the number one cause. Automated fire suppression systems would be useful for addressing this risk.

In commercial settings, large fire suppressions systems have been used. However, these systems are expensive and can be difficult to install. Further, these systems are not readily applicable to the residential setting. Where residential applications have been developed, they are generally miniaturized versions of commercial systems. Such systems, like the full size commercial systems, tend to be cumbersome, expensive, and difficult to install, requiring professional installers. One such miniaturized system is the Guardian residential range-top fire suppression system, which is produced by Twenty First Century International Fire Equipment of Irving, Tex.

SUMMARY

Embodiments of the present invention provide fire suppression systems and methods. One embodiment comprises a housing configured to house a container of a fire suppression material, a delivery block in fluid communication with the container, and a nozzle in fluid communication with the delivery block and configured to disperse the fire suppression material from the delivery block. Such an embodiment can also comprise a power supply; a thermal indicator coupled to the power supply and operable to: detect the presence of a fire, generate a first signal indicating the presence of the fire, and transmit the first signal; and an actuator coupled to the power supply, the actuator in communication with the thermal indicator and configured to cause the fire suppression material to be transferred from the container to the delivery block in response to receipt of the first signal.

Another embodiment of the present invention comprises a method for engaging a fire suppression system. In yet another embodiment, a computer-readable medium (such as, for example random access memory or a computer disk) comprises code for carrying out such a method.

These illustrative embodiments are mentioned not to limit or define the invention, but to provide examples to aid understanding thereof. Illustrative embodiments are discussed in the Detailed Description, and further description of the invention is provided there. Advantages offered by the various embodiments of the present invention may be further understood by examining this specification.

FIGURES

These and other features, aspects, and advantages of the present invention are better understood when the following Detailed Description is read with reference to the accompanying drawings, wherein.

DETAILED DESCRIPTION

Embodiments of the present invention provide fire suppression systems and methods.

Illustrative Fire Suppression System

The prospect of kitchen and other fires is increasing. An application that uses fire suppression chemicals, that is to be installed with little or no technical support, is one of the uses for embodiments of the present invention. For example, one embodiment of the present invention is a range hood fire suppression system for a residential dwelling.

The system comprises a housing that holds a container of fire suppression material. The housing may be located under a range hood, under a microwave, or in a cabinet adjacent to the range hood. The housing protects the container from heat generated by the range, allowing the container to survive until it is needed. An actuator is coupled to the container and is able to discharge the fire suppression material from the container in response to a signal.

The system also comprises a delivery block in fluid communication with the container. The delivery block comprises a thermal indicator, such as a thermistor, which acts as a switch to activate the actuator. When the thermal indicator sends the signal to the actuator to discharge the material, the actuator activates, and the fire suppression material is transferred from the container through the actuator to the delivery block.

The system also comprises one or more nozzles in fluid communication with the delivery block and configured to disperse the fire suppression material that is transferred from the container. In the range hood fire suppression system, the nozzles are aligned so as to provide effective coverage of the cook top. Alignment may be accomplished by the use of a leveling bubble on the delivery block, a pendulum string, or any other type of leveling or alignment device.

This illustrative example is given to introduce the reader to the general subject matter discussed herein. The invention is not limited to this example. The following sections describe various embodiments of systems and methods for fire suppression.

System Design

Figure 1:
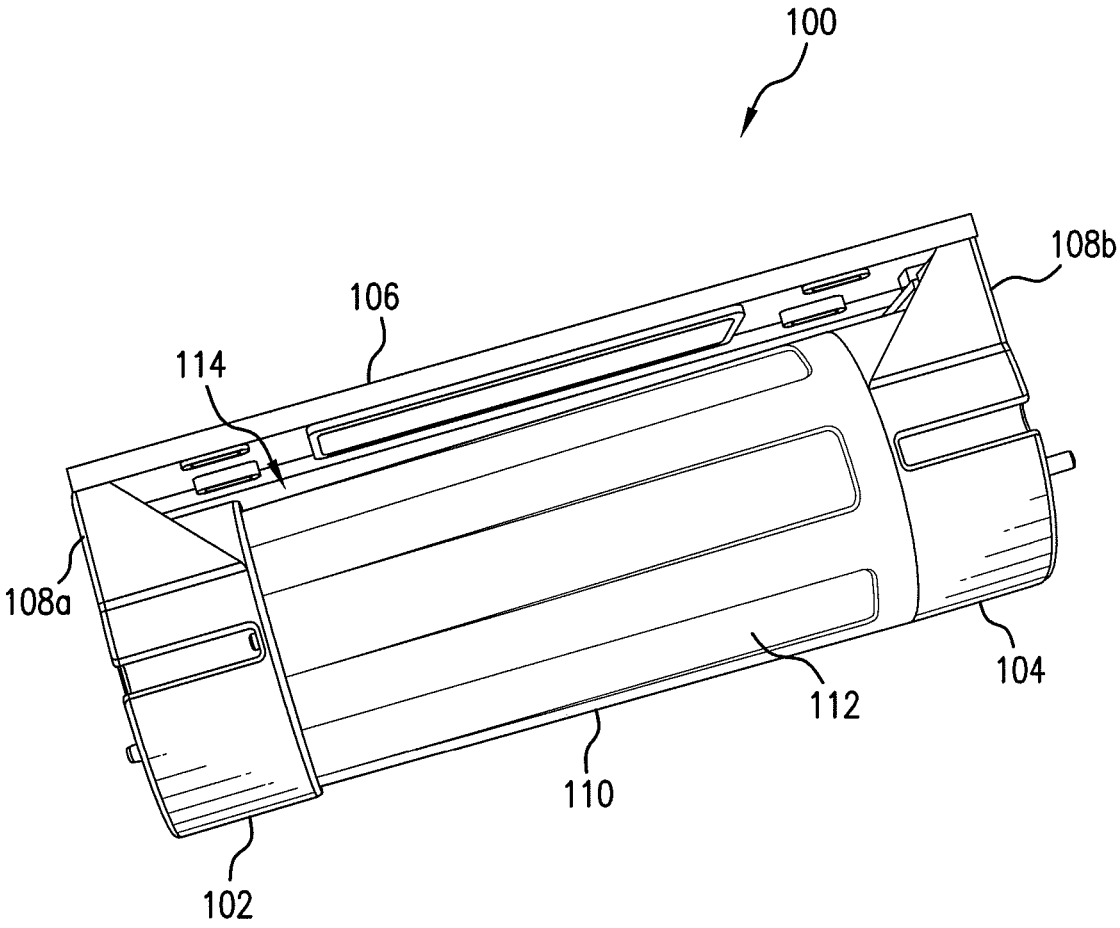
FIG. 1 is a perspective drawing a fire suppression system in one embodiment of the present invention.

FIG. 1 is a perspective view of a fire suppression system in one embodiment of the present invention. The fire suppression system 100 shown comprises a first end cap 102. The end cap 102 is configured to contain the bottom of a container of fire suppression material. The end cap 102 fits against the container to apply pressure to the top of the container where it meets the actuator. The container and actuator are described below.

In one embodiment, twisting of the end cap 102 exerts pressure on the bottom of the container to ensure that it is seated properly. Proper seating allows the stroke of the actuator to properly engage the container as is described below.

The fire suppression system 100 also comprises a second end cap 104. The second end cap 104 contains an actuator assembly.

End caps 102, 104 are attached to a housing bracket 106. The housing bracket 106 may be attached to a surface via adhesive or by fasteners, such as screws. The housing bracket 106 is attached to the end caps 102, 104 by two arms 108*a, b.*

The fire suppression system 100 also comprises a housing 110. The housing 110 comprises a plurality of ribs 112. The ribs 112 help to hold the container in place within the housing 110. For instance, if the fire suppression system 100 is inverted or moved, the container stays in place. In other embodiments, the housing 110 is smooth. A compact housing, such as the housing 110 shown in FIG. 1 may be utilized in some embodiments to allow the fire suppression system 100 to be installed in tight confines. In some embodiments, no housing is utilized. In such an embodiment, the container itself is mounted in or near the hood, and the actuator is affixed to the container itself without the use of a housing.

Various types of containers and materials may be utilized in the fire suppression system. For example, one embodiment utilizes a liquid with foaming properties. One such suitable fire suppression material is manufactured by Pyro Tech, Inc. The Pyro Tech fire suppression formulation is a precise blend of chemicals which, when properly applied to fires that typically occur in areas such as residential kitchens, rapidly suppresses fires (grease, fabric, wood, polyfoam, electrical based fires, etc.) by rapidly cooling the fire environment, by causing little or no exacerbation (flare up) of the fire, by dissipating the fuel's volatility, diluting the remaining fuel, and by providing a foam blanket over the fire surface thereby preventing oxygen from reaching the seat of the fire.

Due to the viscosity of the chemical formulation in such a fire suppression material, a specially designed nozzle may be utilized for maximum fire suppression to occur. Nozzle design can help to insure proper discharge velocity and droplet size. Different nozzle designs may be utilized depending upon the size of surface area to be protected. The fire suppression formulation preferred is commercially available from Pyro Tech, Inc. of Monroe, Va. or Piedmont Chemical Industries II, LLC of High Point, N.C.

Other types of fire suppression material may be used. For example, the fire suppression material may comprise a gas, liquid, foam, powder, or various combinations thereof.

The end caps 102, 104 and the housing 110 may comprise indexing marks (not shown) to allow the container to seat properly in the end caps 102, 104. In the embodiment shown in FIG. 1, the end caps 102, 104 are secured to the cylinder portion of the housing 110 by screws (not shown).

The fire suppression device 100 comprises a gap 114 between the bracket 106 and the housing 110. The gap 114 allows some movement of the housing 110 independent of the bracket 106.

The housing 110 may provide some spacing (not shown) between the inside surface of the housing 110 and the container. This spacing helps protect the container from damage.

The housing 110 may be formed from a plastic. For instance, the housing 110 in one embodiment is formed from ABS (Acrylonitrile Butadiene Styrene) plastic. In another embodiment, the housing is formed from nylon or PVC (Polyvinyl Chloride). The housing 110 may also be made using metals or other materials. The material used for the fire suppression system may be selected based on temperature dissipation profile of the material, depending on where the housing is to be installed. The temperature inside the housing 110 should not exceed the maximum temperature that the container can withstand during the normal cooking cycle of the range. In addition, the material also helps to protect the internal workings of the actuator and of the battery. In one embodiment, an insulation mechanism, such as an air gap or fiberglass, is added within the housing 110 and/or between the housing 110 and the container to help minimize the temperature to which the container and actuator are exposed.

Figure 2:
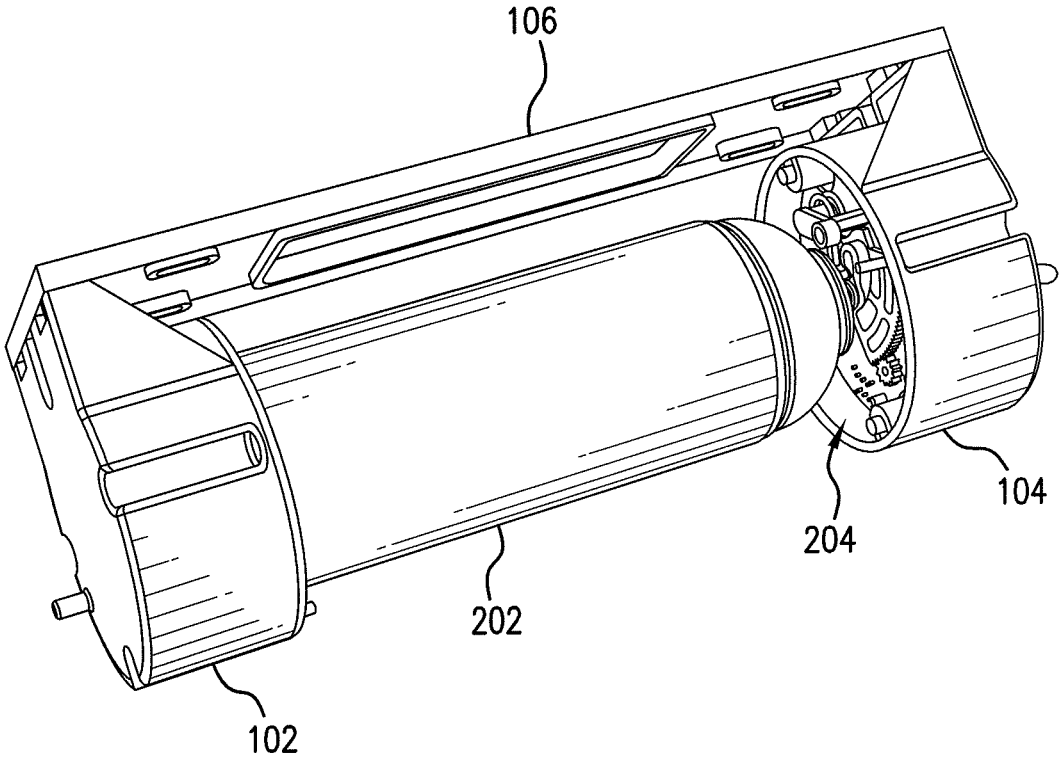
FIG. 2 is a perspective view of a fire suppression system in one embodiment of the invention with the cylinder removed.
Figure 3:
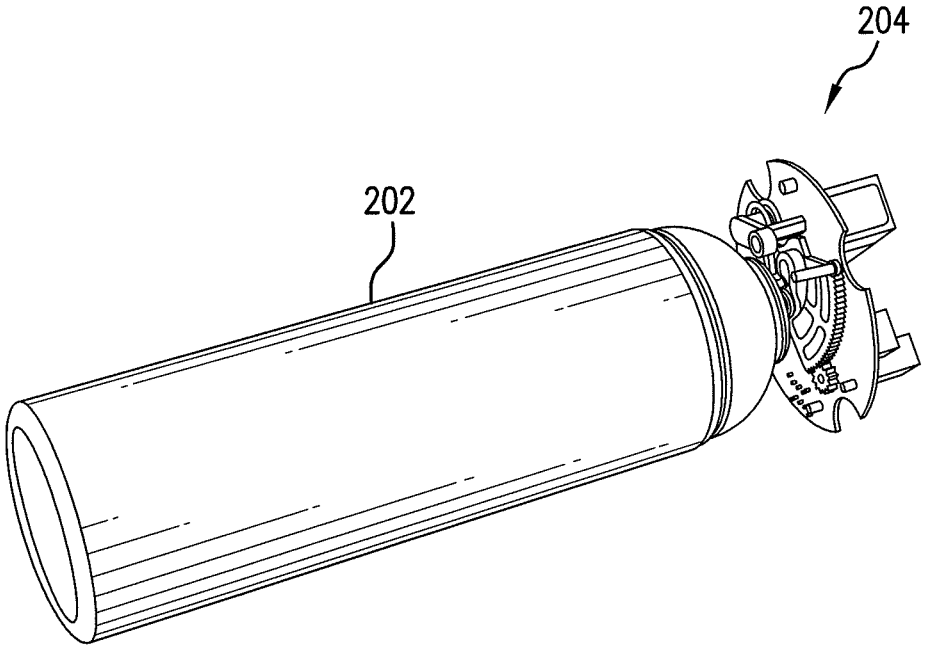
FIG. 3 is a perspective view of a container and actuator assembly in one embodiment of the present invention.
Figure 4:
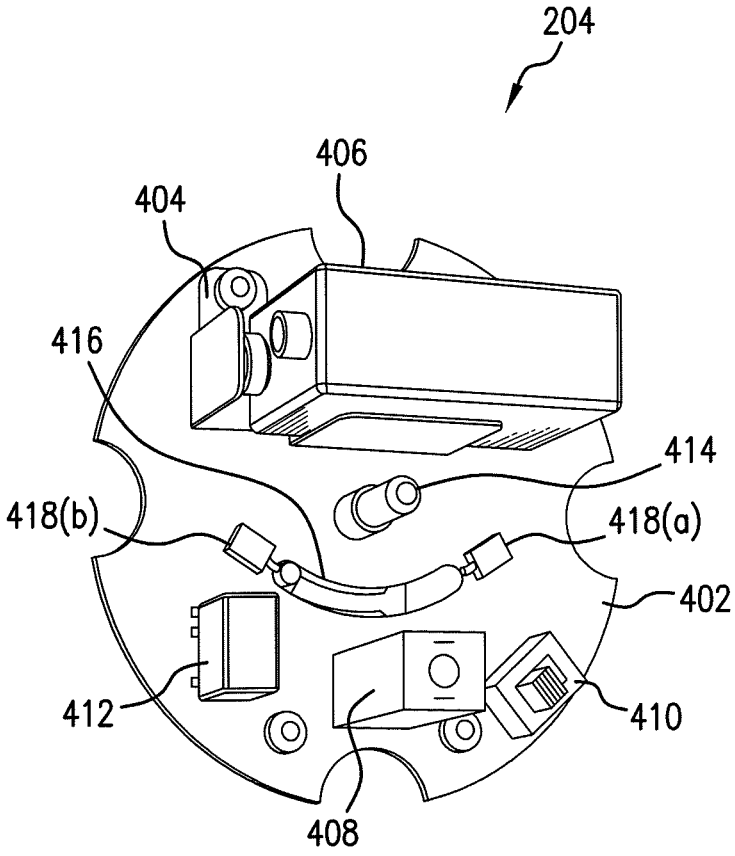
FIG. 4 is a perspective view of a side of an actuator assembly opposite the container in one embodiment of the present invention.
Figure 5:
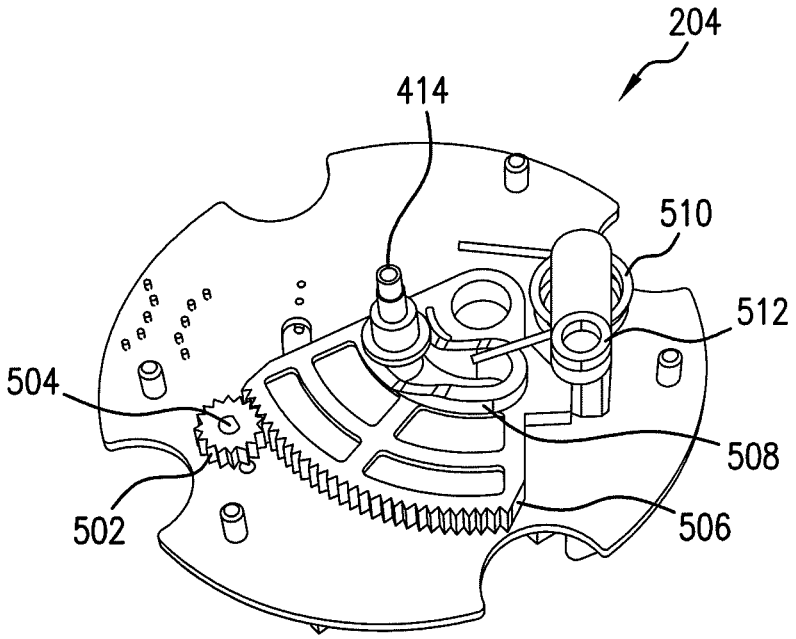
FIG. 5 is a perspective view of the side of an actuator assembly that engages a container in one embodiment of the present invention.

FIG. 2 is a perspective view of a fire safety system in one embodiment of the invention with the cylindrical portion of the housing removed. In FIG. 2, a container 202 is shown between the end caps 102, 104. The container is engaged in the actuator assembly 204. The actuator assembly is shown in FIGS. 3-5 and described in detail in relation to FIGS. 4 and 5. The container may be any of a number of different containers. The container may be pressurized. In one embodiment, the container 202 includes an internal bladder that contains the fire suppression material and a pressurized gas between the bladder and the inside surface of the container 202 that causes the fire suppression material to be completely or substantially completely discharged when an orifice at one end of the container 202 is opened.

FIG. 3 is a perspective view of a container and actuator assembly in one embodiment of the present invention. The container 202 is engaged in the actuator assembly 204. The end caps 102, 104 have been removed in FIG. 3. In the embodiment shown in FIGS. 1 and 2, the housing is designed to allow reloading after activation and discharge with a new container by removing end cap screws, activating a reset button (not shown) to return the system to the ready state, and installing a replacement container along indexing marks (not shown) to allow proper alignment.

FIG. 4 is a perspective view of a side of an actuator assembly opposite the container in one embodiment of the present invention. The actuator assembly 204 shown in FIG. 4 comprises a circuit board 402. Mounted on the board 402 is a power supply, battery housing 404 and a 9-volt battery 406. In other embodiments, other types of power supplies may be utilized. For instance, one embodiment of the present invention comprises an AC power supply with battery backup.

Also mounted on the board 402 is a small electric motor 408. The motor 408 drives a gear assembly illustrated in FIG. 5. The motor 408 may be an "off-the-shelf" low voltage motor. The board 402 also comprises a switch 410 for turning the actuator assembly on and off.

The board 402 shown in FIG. 4 also comprises a relay 412 operable to receive a signal from a thermal indicator (described below). The thermal indicator triggers activation of the motor 408, via the relay 412, and the resulting discharge of material through the discharge tube 414.

In some embodiments, the relay 412 may be replaced or augmented by a processor. The processor executes computer-executable program instructions stored in memory, such as executing one or more computer programs for receiving and sending signals in a fire suppression system. Such processors may comprise a microprocessor, a digital signal processor (DSP), an application-specific integrated circuit (ASIC), field programmable gate arrays (FPGAs), and state machines. Such processors may further comprise programmable electronic devices such as PLCs, programmable interrupt controllers (PICs), programmable logic devices (PLDs), programmable read-only memories (PROMs), electronically programmable read-only memories (EPROMs or EEPROMs), or other similar devices.

Such processors may comprise, or may be in communication with, media, for example computer-readable media, that may store instructions that, when executed by the processor, can cause the processor to perform the steps described herein as carried out, or assisted, by a processor. Embodiments of computer-readable media may comprise, but are not limited to, an electronic, optical, magnetic, or other storage or transmission device capable of providing a processor, such as the processor in a web server, with computer-readable instructions. Other examples of media comprise, but are not limited to, a floppy disk, CD-ROM, magnetic disk, memory chip, ROM, RAM, ASIC, configured processor, all optical media, all magnetic tape or other magnetic media, or any other medium from which a computer processor can read. Also, various other forms of computer-readable media may transmit or carry instructions to a computer, such as a router, private or public network, or other transmission device or channel. The processor, and the processing, described may be in one or more structures, and may be dispersed through one or more structures. The processor may comprise code for carrying out one or more of the methods (or parts of methods) described herein.

The board 402 may include additional components to provide further functionality. For example, in one embodiment, the board 402 includes a component to provide an indication that the power supply is low or non-functional, e.g., providing a low battery chirp. In another embodiment, the board 402 comprises a cut-off, such as a low-voltage cut-off. The cut-off may be implemented by generating an output signal that can be sent to an external device. For example, a low voltage disconnect of a gas supply or an electrical disconnect to an electric range may be triggered in the event of a fire to lessen the severity of the fire. The cut-off may be implemented by having a processor output a cut-off signal. In another embodiment, a processor on the board 402 outputs a signal to a security or communication system when the actuator is activated.

The discharge tube 414 may extend through the end cap. The board 402 also comprises a slot 416 that acts as a guide for one of the actuator assemblies described in relation to FIG. 5 below.

The embodiment shown in FIG. 4 also comprises two switches 418(*a*) and (*b*). The switches 418 cause the motor 408 to stop moving when the sloped trigger (described below) reaches the end of its travel. When the actuator 204 is activated, the switch 418 may cause all or substantially all of the fire suppression material in the container to be dispersed through one or more nozzles. In some embodiments, the actuator 204 is configured to transfer the material to the delivery block in pulses. In such an embodiment, the material may be transferred for a five second on cycle and then turned off for a five-second off cycle. The on/off cycles may be repeated. Other embodiments may use other patterns of material transfer. The nozzles 612 have one or more orifices that will direct by cone spray, fan spray, or stream the materials to the desired location from different heights. These positions will provide the directional elements in linear or orbital patterns for proper aiming or alignment with the surfaces to be treated.

In one embodiment, the board 402 also comprises a reset button (not shown). The reset button allows a user to reset the device. In one such embodiment, the reset button reverses the motor 408, disengaging the actuator from the container 202. It may, for example, allow a user to install another container in the fire suppression system. In one embodiment, a new container cannot be installed until the reset button is pressed. The reset button may also allow for inclusion of a test cycle and may be activated from outside the end cap in which the actuator assembly 204 is situated. In one embodiment, indicator lights are also provided for displaying information such as battery charge, power source, or other types of information.

In one embodiment, the board 402 also comprises an A/C port (not shown). In such an embodiment, the processor 412 may also comprise a power converter. Such an embodiment may utilize A/C power and, during a power outage, revert to battery power.

FIG. 5 is a perspective view of the side of an actuator assembly that engages a container in one embodiment of the present invention. In the embodiment shown, the actuator assembly 204 comprises a gear 502 coupled via a shaft 504 to a motor (shown in FIG. 4) on the opposite side of the actuator assembly 204. In the embodiment shown, gear 502 is a molded plastic gear. However, other types of gears, such as metal gears may be used. In addition, while gear 502 is a round gear, a helical gear or other type of gear may be used instead. When the gear 502 rotates, it causes a discharge assembly 506 to move. Movement of the discharge assembly 506 causes the sloped trigger 508 to force the discharge tube 414 into the end of the container 202, causing material in the container 202 to be discharged through the discharge tube 414. The sloped trigger 508 may also be referred to as a ramp. The sloped trigger 508 is also a molded plastic but may be composed of other materials in other embodiments of the present invention.

A spring 510 applies pressure on a swing arm 512. The swing arm 512, in turn, exerts pressure against the discharge assembly 506 to ensure that enough pressure is exerted on the container 202 to cause the material to be discharged.

Various embodiments of the present invention may utilize a variety of different actuator assemblies that are different than what is shown in FIGS. 4 and 5. For instance, the gear and motor size may be changed. A more powerful motor or lower gear ratio may be used to provide more power or smaller components may be utilized depending upon application.

In one embodiment, the actuator may be rotated or attach to the container 202 at different angles, such as right angles, if necessary to actuate the container 202 or if preferable for discharge from the cap. For instance, if the container 202 has a side orifice, the discharge tube can be configured at right angles to discharge from the top or have a straight configuration to discharge from the side. In one embodiment, the end cap rotates, providing a circular spray pattern.

In one embodiment, the discharge tube 414 is connected directly to a spray cone. In another embodiment, the discharge tube 414 is attached to a hose or plastic tubing. The tubing may, for example, be similar to the tubing used in automotive applications. The tube may be routed through a cabinet so that the end of it can be placed in an optimal position to suppress a fire, such as a fire on a cooking range. The range may be gas or electric.

While the actuator assembly 204 is shown as a single assembly in FIGS. 2-5, it may comprise a plurality of assemblies. For instance, the thermal indicator may be installed remote from the discharge tube and related assembly.

One embodiment comprises an actuator assembly 202 having a rigid tube (not shown) that penetrates the seal or orifice of the container surface. Such a system may use a charged or uncharged line. To accomplish this, the rigid opening tube engages a plate with a camming or an energy transfer surface that depresses the tube into the orifice/diaphragm of the container, allowing the pressurized material to discharge. The transfer plate depresses a collar or indentation along the tube, by means of a slot in the plate. The plate may rotate or move by engaging an electronic motor or mechanical drive. The power source may be a battery or external electrically powered mechanism.

Another embodiment allows the gear drive to depress the tube by use of a linear gear columinator. The actuator in such an embodiment may use a low power indicator for battery applications.

The actuator may comprise other types of actuation such as a solenoid, solenoid combined with a spring, or some other type of electromechanical actuator. In one embodiment, a rubber wheel is utilized. The rubber wheel forces a tube into the container 202 to discharge the material.

Figure 6A:
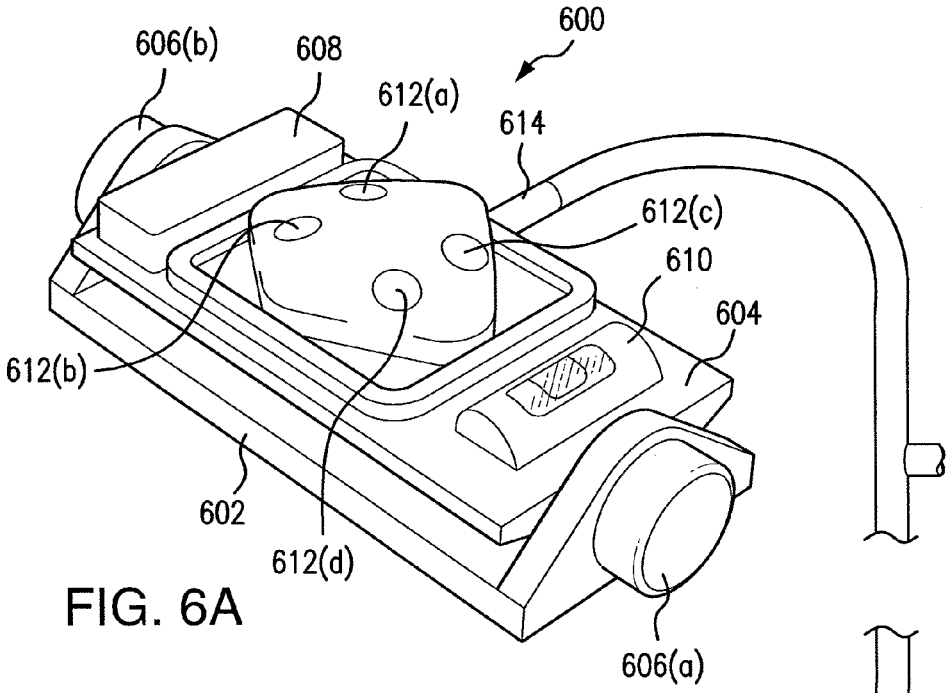
FIG. 6A is a perspective view of a first delivery block in one embodiment of the present invention.

In one embodiment, the tube is connected to a delivery plate or block. FIG. 6A is a perspective view of a delivery block in one embodiment of the present invention. The delivery block 600 shown in FIG. 6A may also be referred to as a manifold. The delivery block 600 may be any of a number of different shapes, depending on where it is to be installed. For instance, in some embodiments, the delivery block 600 can be a narrow plastic component approximately 6-20 inches long, ¼-2 inches thick and 1-4 inches wide. The delivery block 600 comprises a mounting surface 602. The mounting surface 602 is used to mount the delivery block 600 to a surface from which fire suppression material can be effectively distributed onto a fire. For instance, the mounting surface 602 may be mounted to the underside of a range hood or to the underside of a microwave above a range. The mounting surface 602 may be mounted by, for example, adhesive, screws, a magnetic plate, or by some other suitable mounting means.

The delivery block 600 shown in FIG. 6A also comprises a moveable assembly 604. The moveable assembly 604 is attached to the mounting surface by a pair of thumbscrews 606(*a*), (*b*). The thumbscrews 606 allow the moveable assembly 604 to be moved to align the delivery block 600 for effective delivery of the fire suppression material. In other embodiments, other types of fasteners may be used to allow the moveable assembly 604. Some type of indexing, such as marks on the moveable assembly 604 may be present to allow for alignment of the assembly.

The delivery block 600 also comprises a thermal indicator 608. A thermal indicator 608 can detect a fire or other condition by sensing an increase in temperature. The rise in temperature may cause the thermal indicator 608 to generate an electrical or mechanical signal in response to sensing the increase in temperature. In some embodiments, the signal may be sent once the temperature reaches a threshold temperature. In the embodiment shown, the thermal indicator 608 provides a signal to the actuator to transfer the fire suppression material from the container 202 to the delivery block 600. In various embodiments, the thermal indicator 608 may provide electronic or pressure activation of the actuator mechanism. In the embodiment shown in FIG. 6A, the thermal indicator 608 is a thermistor. A thermistor is a thermally sensitive resistor that exhibits a large and precise change in electrical resistance when subjected to a change in temperature. In another embodiment, the thermal indicator 608 may be an infrared sensor. In some embodiments, multiple thermal indicators 608 are utilized. If multiple thermistors are utilized, they may all be connected to the circuit at the same point so that activation of any of the thermistors causes the actuator to transfer the fire suppression material.

Although the embodiment shown in FIG. 6A only comprises a single thermal indicator 608, in other embodiments, multiple thermal indicators 608 might be used to monitor different portions of the area that is being monitored for the presence of a fire.

The delivery block 600 also comprises a leveling bubble 610. The leveling bubble 610 allows the installer or user of the delivery block 600 to align the moveable assembly 604 with a surface or otherwise for effective delivery of the fire suppression material. In other embodiments, a bull's eye bubble may be utilized. In yet another embodiment, the delivery block 600 comprises no leveling bubble.

The delivery block 600 also comprises four nozzles 612 (*a*)-(*d*). The nozzles are in fluid communication with the container of fire suppression material via a nipple 614 on one side of the delivery block 604. The circumference and radius each of the nozzles 612 can be varied to vary the spray pattern. And multiple nozzles 612 may be supplied to a user for use in various applications of embodiments of the present invention. In another embodiment, the nozzles may be mounted separately from the thermal indicator 608 and leveling bubble 610. A tube (not shown) may be used to attach the delivery block 600 to the container or actuator. Such a tube may comprise a length (e.g., 6 or 8 inches) of rigid plastic tubing for delivery of material from the discharge tube 414. In such an embodiment, the delivery block 600 may be omitted. In other embodiments, multiple delivery blocks 600 are utilized with a single housing and container 202. The tube may be substantially longer, e.g., 20 inches, in some embodiments in which the delivery block 600 is remote from the container.

The nozzles 612 shown in FIG. 6A snap into a mounting on the delivery block 600. In other embodiments, the nozzles 612 screw into a tube connected to the nipple 614. Other methods of coupling the nozzles 612 to the delivery block 600 are also possible. In one embodiment, the delivery block 600 and the actuator comprise a single structure. For instance, the delivery block 600 and actuator may be formed as a cap that is attached to the container. The cap may then be aligned for effective distribution of the fire suppression material.

In the embodiment shown in FIG. 6A, the moveable assembly 604 allows an installer or a user to aim the nozzles 612 so that they effectively distribute the fire suppression material. In other embodiments, the moveable assembly is omitted, and the installer or user simply mounts the deliver block 600 in a way such that the nozzles 612 are properly oriented.

The nipple 614 allows for attachment of the tube. A second nipple on the second side of the delivery block 600 allows for installation of a nozzle 612, which can be used to determine the spray pattern of material discharged through the actuator assembly 204.

Various other elements may be present in an embodiment of the present invention. For instance, in one embodiment, the circuit board 402 comprises a communications port (not shown). The communications port allows the device to communicate wired or wirelessly with, for example, emergency personnel, notifying them that the device has discharged. In one such embodiment, the communications port is used to communicate with a heating, ventilation, and air conditioning (HVAC) system, instructing the HVAC system to shut off the air handler when the device is activated.

Figure 6B:
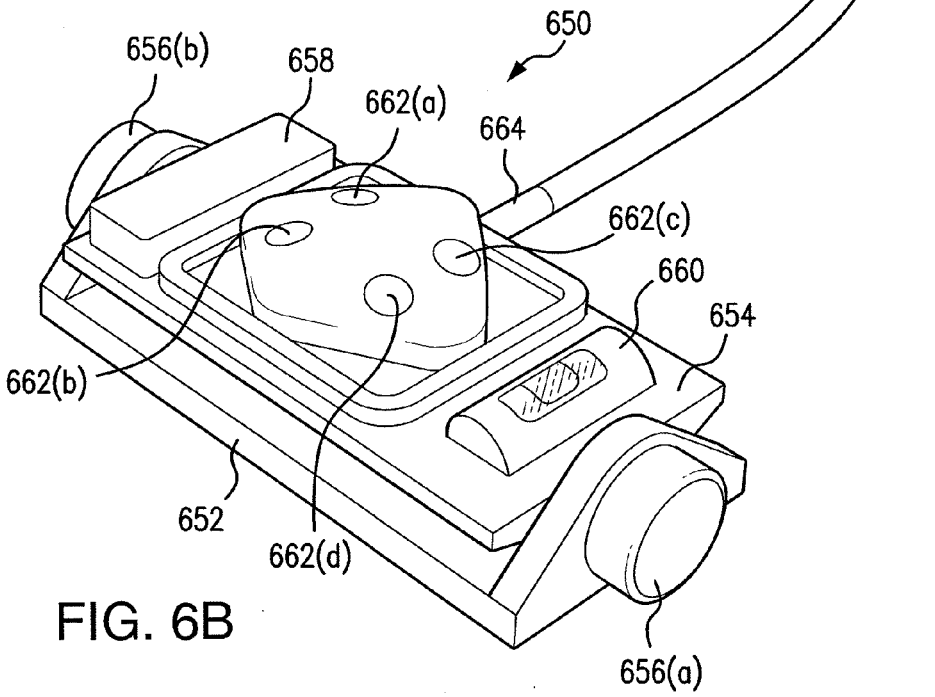
FIG. 6B is a perspective view of a second delivery block in one embodiment of the present invention.

FIG. 6B is a perspective view of a second delivery block in one embodiment of the present invention. FIG. 6B comprises a second delivery block 650, which is similar to delivery block 600 shown in FIG. 6A. Delivery block 650 comprises a mounting surface 652, which is used to mount delivery block 650 to a surface from which fire suppression material can be effectively distributed onto a fire. Delivery block 650 comprises a thermal indicator 658, which may comprise a thermistor or infrared sensor. Delivery block 650 further comprises a leveling bubble 660. Delivery block 650 further comprises four nozzles 662(*a*)-(*d*), which are in fluid communication with the container of fire suppression material via a nipple 664, which in some embodiments is affixed to a hose. Delivery block 650 further comprises a moveable assembly 654, which is attached to the mounting surface by a pair of thumbscrews 656(*a*), (*b*). Moveable assembly 654 allows an installer or user to aim nozzles 662(*a*)-(*d*) so that they effectively distribute the fire suppression material.

In another embodiment, the fire suppression device is installed in the HVAC system. When the thermal or other detector senses a condition necessitating discharge of the suppression material, the material is discharged, the device signals the HVAC system to run the air handler to circulate the suppression material, pauses for sixty second or some other period of time, then signals the HVAC system to disable the air handler. Such an embodiment circulates the suppression material in the air, helps to prevent fires in the HVAC system, and helps to suppress the spread of fire or other contaminants by stopping the flow of air in the system.

The fire suppression device may incorporate a variety of finishes and colors. Such finishes and colors may be used to ensure that the device coordinates with the room in which it is installed or may be functional in nature, e.g., may enhance the visibility or heat dissipation characteristics of the device.

Use and Control of the Fire Suppression System

Figure 7:
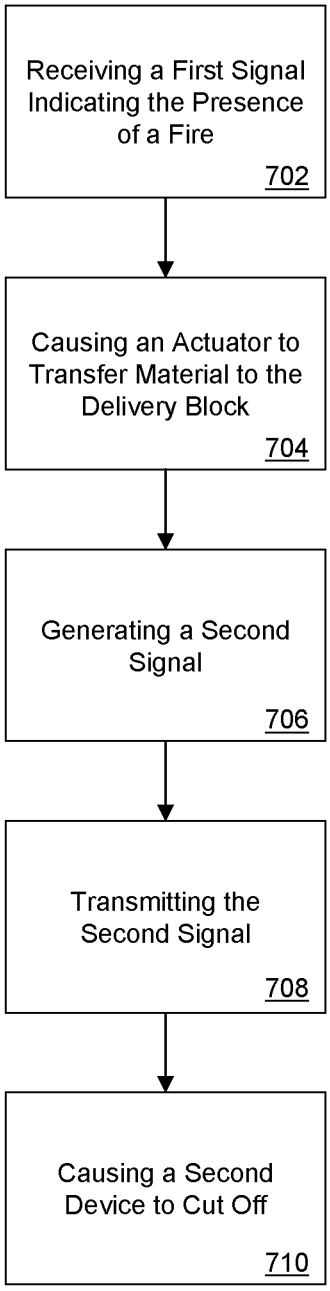
FIG. 7 is a flow chart illustrating a method implemented by a fire suppression system in one embodiment of the present invention.

FIG. 7 is a flow chart illustrating a method implemented by a fire suppression system in one embodiment of the present invention. In the embodiment shown, a processor receives a first signal indicating the presence of a fire from a thermal indicator 702. The thermal indicator 702 may simply act as a switch.

In response, the processor causes an actuator to transfer a fire suppression material from a container 202 to a delivery block 600 in fluid communication with the container 704. The delivery block 600 may contain nozzles, which are used to disperse the material form the delivery block 600 onto the surface to be protected.

The processor then generates a second signal 706. The second signal may be generated for a security system or for other standardized systems. The processor then outputs this signal 708.

In the embodiment shown, the second signal is configured to engage a cut-off 710. For instance, in one embodiment, the fire suppression system is a range top system for a gas stove. When the second signal is transmitted, it causes the gas supply to be cut off. In other embodiments, the second signal may be configured to trigger a communication. For instance, the fire suppression system may be configured to communicate with a security system such that the transmission of the second signal sets off a fire alarm and alerts whoever is monitoring the security system that a fire may have occurred.

Embodiments of the present invention may be used in a broad array of applications. For example, some embodiments may be utilized for fire suppression in kitchens in residential dwellings or in areas subject to assembly use ordinances, such as a church or community center. For example, one embodiment of the present invention may be installed under a standard range hood approximately thirty inches above a standard range top to suppress fires. In another embodiment, the fire suppression system is placed under a microwave, which is approximately seventeen to eighteen inches above the range top. The system is not limited to these two heights; it may be installed in any location above the surface. In another embodiment, two suppression units are installed above a commercial grade cook top in a residential kitchen. The two units may be actuated together or separately. Other potential applications of embodiments of the present invention comprise a gas-fired furnace and a computer or electronics cabinet.

Embodiments may also be used in recreational vehicles, manufactured housing, marine environments, airliners, fuel storage facilities, and assisted care facilities. For example, in one embodiment a fire suppression system is installed in the engine compartment of a boat. Embodiments of the present invention may also be utilized in commercial or industrial applications where there is a potential for fire.

In one embodiment, a user installs a bottle, can, or other container 202 of material in the fire suppression system and may turn on the actuator assembly, or the actuator assembly may turn on automatically. When the actuator assembly 204 senses conditions of a fire, the actuator assembly 204 causes the fire suppression material to be discharged from the container 202.

Embodiments of the present invention provide various advantages. For instance, they have a lower initial purchase cost than conventional fire suppression devices. Also, such devices require maintenance similar to that of conventional smoke detectors, which is simpler and less expensive that what is required for conventional fire suppression equipment.

In addition, embodiments of the present invention incorporate a low-tech, simple installation and allow for multiple types of installation optimized for the type of application to which the fire suppression system is being applied. Embodiments of the present invention may also be concealed, and depending on the type of suppression material used may have a long shelf life.

In addition to cost and installation benefits, embodiments of the present invention help to mitigate risk and loss, providing protection against loss of life and injury as well as against property damage. Such embodiments are capable of rapidly suppressing fires within their design parameters.

General

The foregoing description of embodiments of the invention has been presented only for the purpose of illustration and description and is not intended to be exhaustive or to limit the invention to the precise forms disclosed. Numerous modifications and adaptations thereof will be apparent to those skilled in the art without departing from the spirit and scope of the present invention.

That which is claimed:

1. A fire suppression system comprising:

a housing configured to house a container of a fire suppression material;

a delivery block in fluid communication with the container, the delivery block comprising:

a mounting surface configured to mount the delivery block on an external surface; and a moveable assembly operable to align the delivery block;

a nozzle in fluid communication with the delivery block and configured to disperse the fire suppression material from the delivery block;

a power supply;

a thermal indicator coupled to the power supply and operable to:

detect the presence of a fire, generate a first signal indicating the presence of the fire, and transmit the first signal; and an actuator coupled to the power supply, the actuator in communication with the thermal indicator and configured to cause the fire suppression material to be transferred from the container to the delivery block in response to receipt of the first signal, wherein the actuator comprises:

a motor having a shaft;

a gear coupled to the shaft; and a discharge assembly engaged with the gear, the discharge assembly comprising a sloped trigger comprising a sloped track and further comprising a discharge tube configured to move along the sloped track, the discharge assembly configured to rotate when the gear is rotated and thereby move the sloped trigger and push the discharge tube into the container.

2. The system of claim 1, wherein the sloped trigger comprises a ramp.

3. The system of claim 1, wherein the fire suppression material comprises a liquid having foaming properties.

4. The system of claim 1, wherein the delivery block and actuator comprise a single structure.

5. The system of claim 1, wherein the nozzle comprises a first nozzle and further comprising a second nozzle.

6. The system of claim 1, wherein the thermal indicator comprises an infrared detector.

7. A fire suppression system comprising:

a housing configured to house a container of a fire suppression material;

a delivery block in fluid communication with the container, the delivery block comprising:

a mounting surface configured to mount the delivery block on an external surface; and a moveable assembly operable to align the delivery block;

a nozzle in fluid communication with the delivery block and configured to disperse the fire suppression material from the delivery block;

a power supply;

a thermal indicator coupled to the power supply and operable to:

detect the presence of a fire, generate a first signal indicating the presence of the fire, and transmit the first signal; and an actuator coupled to the power supply, wherein the actuator comprises at least one shut-off switch and is in communication with the thermal indicator and configured to cause the fire suppression material to be transferred from the container to the delivery block in response to receipt of the first signal, and wherein the actuator further comprises a discharge assembly comprising a sloped trigger comprising a sloped track and further comprising a discharge tube configured to move along the sloped track, the discharge assembly configured to rotate when the gear is rotated and thereby move the sloped trigger and push the discharge tube into the container.

8. The system of claim 7, wherein the fire suppression material comprises a liquid having foaming properties.

9. The system of claim 7, wherein the delivery block is remote from the actuator and housing.

10. The system of claim 7, wherein the delivery block and actuator comprise a single structure.

11. The system of claim 7, wherein the delivery block comprises a moveable assembly for aiming the nozzle.

12. The system of claim 11, wherein the moveable assembly comprises an alignment device.

13. The system of claim 7, wherein the delivery block comprises a first delivery block and further comprising a second delivery block.

14. The system of claim 13, wherein the nozzle comprises a first nozzle in fluid communication with the first delivery block and further comprising a second nozzle in fluid communication with the second delivery block.

15. The system of claim 7, wherein the nozzle comprises a first nozzle and further comprising a second nozzle.

16. The system of claim 7, wherein the thermal indicator comprises a first thermal indicator and further comprising a second thermal indicator.

17. The system of claim 7, wherein the thermal indicator comprises a thermistor.

18. The system of claim 7, wherein the thermal indicator comprises an infrared detector.

19. The system of claim 7, wherein the power supply comprises a battery and wherein the actuator comprises a low power indicator.

20. The system of claim 7, wherein the actuator is further configured to generate a second signal in response to the first signal.

21. The system of claim 20, wherein the second signal is operable to engage a cut-off.

22. The system of claim 21, wherein the cut-off comprises a gas line cut-off.

23. The system of claim 21, wherein the cut-off comprises an electrical cut-off.

24. A fire suppression system comprising:

a housing configured to house a container of a fire suppression material;

an end cap configured to position the container;

a delivery block in fluid communication with the container, the delivery block comprising:

a mounting surface configured to mount the delivery block on an external surface; and a moveable assembly operable to align the delivery block;

a plurality of nozzles in fluid communication with the delivery block and configured to disperse the fire suppression material from the delivery block;

a power supply;

a thermal indicator coupled to the power supply and operable to:

detect the presence of a fire, generate a first signal indicating the presence of the fire, and transmit the first signal; and an actuator coupled to the power supply, wherein the actuator comprises a reset button and is in communication with the thermal indicator and configured to cause the fire suppression material to be transferred from the container to the delivery block in response to receipt of the first signal, and wherein the actuator further comprises a discharge assembly comprising a sloped trigger comprising a sloped track and further comprising a discharge tube configured to move along the sloped track, the discharge assembly configured to rotate when the gear is rotated and thereby move the sloped trigger and push the discharge tube into the container.

25. The system of claim 24, wherein the fire suppression material comprises a liquid having foaming properties.

26. The system of claim 24, wherein the delivery block and actuator comprise a single structure.

27. The system of claim 24, wherein the nozzle comprises a first nozzle and further comprising a second nozzle.

28. The system of claim 24, wherein the thermal indicator comprises an infrared detector.

29. A method for suppressing a fire comprising:

receiving a first signal indicating a presence of a fire from a thermal indicator;

causing an actuator to transfer a fire suppression material from a container to a delivery block in fluid communication with the container in response to receipt of the first signal, wherein the actuator comprises a reset button wherein the fire suppression material is dispersed from the delivery block mounted on an external surface through a plurality of nozzles, and wherein the actuator further comprises a discharge assembly comprising a sloped trigger comprising a sloped track and further comprising a discharge tube configured to move along the sloped track, the discharge assembly configured to rotate when the gear is rotated and thereby move the sloped trigger and push the discharge tube into the container.

30. The method of claim 29, further comprising:

generating a second signal in response to the first signal; and outputting the second signal.

31. The method of claim 30, wherein the second signal is configured to engage a cut-off.

32. The method of claim 30, wherein the second signal is configured to trigger a communication.

33. The method of claim 29, wherein the actuator is configured to transfer the material in pulses.

* * * * *